US005929832A

United States Patent [19]

Furukawa et al.

[11] Patent Number: 5,929,832

[45] **Date of Patent: *Jul. 27, 1999**

[54] MEMORY INTERFACE CIRCUIT AND ACCESS METHOD

[75] Inventors: Hiroyuki Furukawa, Ueno; Kunihiko Yamamoto, Kashiba, both of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/609,475

[22] Filed: Mar. 1, 1996

[30] Foreign Application Priority Data

Mar. 28, 1995 [JP] Japan ..... 7-069988

[51] Int. Cl.[6] ..... G09G 3/36

[52] U.S. Cl. ..... 345/98; 345/103; 345/99

[58] Field of Search ..... 345/94, 100, 103, 345/185, 98, 99, 87, 208, 213, 507

[56] References Cited

U.S. PATENT DOCUMENTS

| | | | |
|---|---|---|---|
| 4,630,122 | 12/1986 | Morokawa | 345/100 |
| 4,679,043 | 7/1987 | Morokawa | 345/103 |
| 4,929,058 | 5/1990 | Numao . | |
| 5,262,881 | 11/1993 | Kuwata et al. . | |
| 5,376,944 | 12/1994 | Mogi et al. | 345/100 |
| 5,420,604 | 5/1995 | Scheffer et al. . | |
| 5,457,551 | 10/1995 | Culter et al. . | |
| 5,459,482 | 10/1995 | Orien . | |
| 5,459,495 | 10/1995 | Scheffer et al. . | |

(List continued on next page.)

FOREIGN PATENT DOCUMENTS

| | | | |
|---|---|---|---|
| 0585466 A1 | 3/1994 | European Pat. Off. . | |
| 0595495 A2 | 5/1994 | European Pat. Off. . | |
| 5-46127 | 2/1993 | Japan . | |
| 5-100642 | 4/1993 | Japan . | |
| 5-143019 | 6/1993 | Japan | 345/103 |
| 5-150750 | 6/1993 | Japan . | |
| 6-4049 | 1/1994 | Japan . | |
| 6-51717 | 2/1994 | Japan . | |
| 6-27908 | 4/1994 | Japan . | |
| 6-67626 | 11/1994 | Japan . | |
| 2280980 | 2/1995 | United Kingdom . | |

OTHER PUBLICATIONS

Nehring et al, "Ultimate Limits for Matrix Addressing of RMS–Responding Liquid–Crystal Displays",IEEE Transactions on Electron Devices, vol. ED–26, No. 5, May 1979, pp. 795–802.

Ruckmongathan et al, "S3–4 A New Addressing Technique for Fast Responding STN LCDs", Japan Display, '92, pp. 65–68, 1992.

Scheffer et al, "13.4: Active Addressing Method for High–Contrast Video–Rate STN Displays", SID 92 Digest, pp. 228–231, 1992.

(List continued on next page.)

*Primary Examiner*—Xiao Wu

*Attorney, Agent, or Firm*—Nixon & Vanderhye, P.C.

[57] ABSTRACT

The memory interface circuit converts an input data signal into multi-scan data signals used for a multi-scan type liquid crystal display. The memory interface circuit includes: a memory for storing one frame of the input data signal corresponding to the display panel, and a control circuit for controlling write/read operations for the memory so that the input data signal is sequentially written in the memory in a single-scan manner, and that data stored in the memory is read out as first and second multi-scan signals in a multi-scan manner. The control circuit controls timing of read operations so that a read operation for the second multi-scan signal is started a predetermined time after that for the first multi-scan signal is started, the predetermined time being equal to a delay time of a write operation of the input data corresponding to the second portion with respect to that corresponding to the first portion.

19 Claims, 9 Drawing Sheets

U.S. PATENT DOCUMENTS

| | | | |
|---|---|---|---|
| 5,475,397 | 12/1995 | Saidi | 345/100 |
| 5,485,173 | 1/1996 | Scheffer et al. . | |
| 5,489,919 | 2/1996 | Kuwata et al. . | |
| 5,512,916 | 4/1996 | Merchant et al. . | |
| 5,521,727 | 5/1996 | Inaba et al. . | |
| 5,548,302 | 8/1996 | Kuwata et al. . | |
| 5,596,344 | 1/1997 | Kuwata et al. . | |
| 5,598,179 | 1/1997 | Orien et al. . | |

OTHER PUBLICATIONS

Ruckmongathan, "Addressing Techniques for RMS Responding LCDs —A Review", Japan Display '92, pp. 77–80, 1992.

Kudo et al, "Study on Driving Methods for Fast–Responding STN–LSDs", Technical Report of IEICE, EID94–129, ED94–157, SDM94–186, pp. 13–18, 1995.

Ruckmongathan, "A Generalized Addressing Technique for RMS Responding Matrix LCDS", 1988 International Display Research Conference, pp. 80–85, 1988.

Ruckmongathan et al, "A New Addressing Technique for Fast Responding STN LCDs", Japan Display '92, pp. 65–67, 1992.

FIG. 2A

AA method

| | | | | | | | |
|---|---|---|---|---|---|---|---|
| 1 | 1 | 1 | 1 | 1 | 1 | 1 | 1 |
| 1 | -1 | 1 | -1 | 1 | -1 | 1 | -1 |
| 1 | 1 | -1 | -1 | 1 | 1 | -1 | -1 |
| 1 | -1 | -1 | 1 | 1 | -1 | -1 | 1 |
| 1 | 1 | 1 | 1 | -1 | -1 | -1 | -1 |
| 1 | -1 | 1 | -1 | -1 | 1 | -1 | 1 |
| 1 | 1 | -1 | -1 | -1 | -1 | 1 | 1 |
| 1 | -1 | -1 | 1 | -1 | 1 | 1 | -1 |

FIG. 2B

Dispersion type MLS

| | | | | | | | | | | | | | | | |
|---|---|---|---|---|---|---|---|---|---|---|---|---|---|---|---|
| 1 | 0 | 1 | 0 | 1 | 0 | 1 | 0 | 0 | 1 | 0 | 1 | 0 | 1 | 0 | 1 |
| 1 | 0 | -1 | 0 | 1 | 0 | -1 | 0 | 0 | 1 | 0 | -1 | 0 | 1 | 0 | -1 |
| 1 | 0 | 1 | 0 | -1 | 0 | -1 | 0 | 0 | 1 | 0 | 1 | 0 | -1 | 0 | -1 |
| 1 | 0 | -1 | 0 | -1 | 0 | 1 | 0 | 0 | 1 | 0 | -1 | 0 | -1 | 0 | 1 |

FIG. 2C

Non-dispersion type MLS

| | | | | | | | | | | | | | | | |
|---|---|---|---|---|---|---|---|---|---|---|---|---|---|---|---|
| 1 | 1 | 1 | 1 | 0 | 0 | 0 | 0 | 0 | 0 | 0 | 0 | 1 | 1 | 1 | 1 |
| 1 | -1 | 1 | -1 | 0 | -0 | 0 | -0 | 0 | 0 | 0 | 0 | 1 | 1 | 1 | 1 |
| 1 | 1 | -1 | -1 | 0 | 0 | -0 | -0 | 0 | 0 | 0 | 0 | 1 | -1 | 1 | -1 |
| 1 | -1 | -1 | 1 | 0 | -0 | -0 | 0 | 0 | 0 | 0 | 0 | 1 | -1 | 1 | -1 |

MEMORY INTERFACE CIRCUIT AND ACCESS METHOD

RELATED APPLICATIONS

This application is related to copending commonly assigned applications Ser. No. 08/425,469 filed Apr. 20, 1995 and Ser. No.08/725,395 filed Oct. 3, 1996.

BACKGROUND OF THE INVENTION

1. Field of the Invention

The present invention relates to a memory interface circuit for a display device and an access method of the memory interface circuit. More particularly, the invention relates to a memory interface circuit and an access method for converting a single-scan data signal which is suitable for displays such as CRTs or active-matrix liquid crystal displays, into a dual-scan data signal which is suitable for fast-responding passive-matrix liquid crystal displays.

2. Description of the Related Art

The two primary types of liquid crystal displays (LCDs) which have evolved over the years have been active-matrix LCDs and passive-matrix LCDs. Active-matrix LCDs utilize, as switching elements, thin film transistors (TFTs) or other active devices such as metal-insulator-metal (MIM) elements. The switching elements are disposed at every pixel location, i.e., at every crossing of scanning signal lines (rows) and data signal lines (columns). The liquid crystal material in an active-matrix LCD is commonly driven in a twisted nematic (TN) mode, and each switching element is used to apply a constant voltage directly and independently to the corresponding pixel. The result is fast pixel response and excellent contrast.

TFTs are fabricated by depositing and patterning a semiconductor material on a substrate through a series of complex photolithography processes. This results in low fabrication yields and corresponding high costs associated with active-matrix displays. Consequently, it is particularly difficult to realize high definition active-matrix LCDs having a large size with a low cost.

In passive-matrix LCDs, the liquid crystal material is commonly driven in a supertwisted nematic (STN) mode. Since the passive-matrix LCDs do not require active switching elements at every pixel, passive-matrix LCDs are relatively easy to manufacture so that large-sized display panels can be realized at a considerably lower cost than that of active-matrix LCDs.

In a conventional STN passive-matrix LCD, the pixels are addressed in a sequential row-by-row manner. Initially, a large voltage pulse is applied to the first row while a zero voltage is applied to all the other rows. An additional voltage for display is applied to each column corresponding to each pixel in the thus selected first row which is to be turned on. The voltage applied to the first row is then turned to zero and a large voltage pulse is applied to the second row which is next to be selected. In this way, the entire display is scanned one row at a time before again selecting the first row. This type of driving method is referred to as duty driving. In duty driving, a selected pixel receives a single selection pulse having a relatively high voltage level once a frame period.

This straightforward row-by-row selection or addressing has been effective in conjunction with slow-response LC material since the LC material itself tends to average the effect of the applied effect across many frames. The response of the LC material is too slow to react to the instantaneous pulse applied during a single row-selection time. Thus, the LC material responds to an effective value of the applied voltage and the optical state of the pixel is determined by the root-mean-square (rms) value of the applied voltage.

Suppose the effective voltage value applied to a selected pixel and that applied to a non-selected pixel is represented by $V_{on(rms)}$ and $V_{off(rms)}$, respectively. The maximum value of a selection ratio $V_{on(rms)}/V_{off(rms)}$ is given by the following expression:

$$\frac{V_{on(\mathrm{rms})}}{V_{off(\mathrm{rms})}} = \sqrt{\frac{\sqrt{N}+1}{\sqrt{N}-1}} \qquad \text{(Eq.1)}$$

where N is a number of rows (scanning signal lines), and 1/N is a duty number. The voltage $V_{off(rms)}$ is usually set at a threshold voltage $V_{th}$ of the LC material. As long as the LC material responds to the rms value of the applied voltage, an adequate contrast can be obtained in the display.

However, in order to use passive-matrix LCDs for television, computer monitors, video games, and the like, the passive-matrix LCDs are required to respond quickly enough for displaying video images and mouse use, as well as provide high resolution. It is not difficult to make a fast-responding LCD panel by using a thinner cell gap or a low-viscosity LC mixture so as to reduce a characteristic time constant of the LCD. However, these changes make the liquid crystal material in the pixels respond to large pulses of a voltage signal used for addressing but not to the rms value of the applied voltage signal. This degrades the contrast of the LCDs when addressed by the above mentioned sequential row-by-row scanning. As the characteristic time constant of the LCD approaches the frame time, in a selected pixel, a transmission state of the LC material which is allowed by the selection pulse of the voltage signal cannot be held for one frame period although a sufficient rms voltage value $V_{on(rms)}$ is applied to the pixel. This reduces an on-state transmittance of the selected pixel. Similarly, in a non-selected pixel, an off-state transmittance is increased although a rms voltage value $V_{off(rms)}$ is set at $V_{th}$. This results in flicker, low contrast, display noise, and the like, and is referred to as "frame response".

Accordingly, in order to obtain high contrast of fast-responding STN-LCDs with high resolution, this "frame response" effect should be counteracted by some method. For this purpose, an addressing technique has been proposed in which a plurality of scanning signal lines are selected simultaneously, and each row (scanning signal line) is supplied with a plurality of relatively small selection pulses per frame. This technique is referred to as "active driving" compared with the above mentioned duty driving. Active driving utilizes a cumulative response of the LC material so as to realize high contrast and fast response.

In passive-matrix LCDs, each pixel cannot be directly driven. Thus, if a plurality of scanning signal lines are selected simultaneously, a display data signal for pixels on a selected scanning signal line interferes with the display data signal for pixels on other selected scanning signal lines via the corresponding data signal lines. Therefore, in order to drive passive-matrix LCDs using the active driving technique, an input video data signal is required to be transformed by an orthogonal matrix prior to being applied to the data signal lines. Based on such transformation, the original input video data is reproduced on the display by multi-line selection of the scanning signal lines.

FIG. 1 shows an conventional LCD device 100 which utilizes an active driving method. As shown in FIG. 1, the LCD device 100 includes a fast-responding LCD panel 101, a segment driver (data driver) 102 for driving data electrodes (not shown) of the LCD panel 101, and a common driver (scanning driver) 103 for driving scanning electrodes (not shown) of the LCD panel 101. In addition, the LCD device 100 includes an orthogonal function ROM 104 for storing orthogonal functions, and an orthogonal transformer 105 for performing an orthogonal transform of an input video data signal according to the orthogonal functions stored in the orthogonal function ROM 104.

The orthogonal transformer 105 transforms the input video data signal using an orthogonal matrix provided by the orthogonal function ROM 104. The transformed video data is applied to the data electrodes via the segment driver 102 as data signals. Column vector elements of the orthogonal matrix are applied via the common driver 103 to the scanning electrodes as pulse scanning signals. Thus, an inverse orthogonal transform is performed on the transformed video data on the LCD panel 101 so that the input video data is reproduced on the LCD panel 101.

The above described active driving technique is categorized into two methods, namely active addressing (AA) and multiple line selection (MLS). The AA method is described for example, in T. J. Scheffer, et. al., SID '92 Digest, pp. 228–231, and Japanese Laid Open Patent No. 5-100642 (corresponding U.S. Pat. No. 5,420,604). In the AA driving method, all the scanning electrodes are selected at a time. The scanning signals, which are generated by ortho-normal functions such as Walsh functions, are applied to the all scanning electrodes. The scanning signals have two voltage levels (positive and negative).

The MLS method is described, for example, in T. N. Ruchmongathan et al., Japan Display, '92 Digest, p. 65, T. N. Ruchmongathan, Japan Display '92, pp. 77–80, and Japanese Laid Open Patent No. 5-46127. In the MLS method, one frame period is equally divided into a plurality of subperiods, and scanning electrodes are divided into subgroups. A different subgroup of scanning electrodes is selected every subperiod, so that every scanning electrode is selected once a frame period by subgroup.

The number of the scanning electrodes which are selected simultaneously in the MLS method is smaller than that in the AA method, so that the MLS method has an advantage of decreasing the size of a computation circuit for orthogonal functions for performing orthogonal transforms. However, the MLS method needs a three-value driver for the scanning electrodes, since the scanning signals are required to have two selected voltage levels (positive and negative) and a non-selected voltage level (zero).

In the MLS method, in the case where a selection number n of the scanning electrodes which are included in each subgroup (i.e., the number of the scanning electrodes which are selected simultaneously) is relatively small, a multi-level driver which has n+1 output voltage levels is required for driving the data electrodes. In the MLS method in which the selection number n is relatively large and in the AA method, an analog output driver is required for driving the data electrodes since the load of the data electrodes increases.

The MLS method includes two types, dispersion type and non-dispersion type, with respect to how to select an orthogonal function matrix. FIGS. 2A to 2C show examples of orthogonal function matrices for the AA method, the dispersion type MLS method, and the non-dispersion type MLS method, respectively. In the dispersion type MLS method, selection pulses are distributed relatively uniformly over one frame in the scanning signals. Thus, in general, the dispersion type MLS method can achieve good contrast by a smaller selection number n of the scanning electrodes as compared to that of the non-dispersion type MLS method. For example, in fast-responding STN-LCD panels having VGA resolution, the selection number n is usually set in a range of 7 to 15 for the dispersion type MLS method, while n is set in the range of 60 to 120 for the non-dispersion type MLS method.

In order to perform an orthogonal transform for the input video data signal, n elements of a display video data vector in a column direction and corresponding elements in a column vector of the orthogonal function matrix are multiplied and summed together. Therefore, the video data is required to be scanned in the column direction on a display screen in the active driving method. Since conventional video data for televisions, personal computer monitors, and the like is scanned in the row direction of the display screen, means for storing the video data signal such as a frame memory is required in order to rearrange the video data signal so as to be correctly displayed on the screen of the LCD utilizing the active driving method.

The capacity of a frame memory depends on the structure of the orthogonal function matrix, i.e., the operation procedure in a frame period. In the AA method and the dispersion MLS method, the selection pulses of the scanning signals are distributed over one frame period, so that the frame memory should have a capacity for storing the video data signal for one frame.

In addition, in order that the inverse orthogonal transform be performed on the LCD panel so as to display the original video data of the current frame, the video data stored in the frame memory should not be changed for one frame period, since the orthogonal transform and the corresponding inverse transform are completed by respective processes through one frame period. Therefore, during the time when the stored video data of one frame is being read out from the frame memory and displayed on the LCD panel, the input video data of the next frame should be written in another frame memory. In this manner, the input video data signal is continuously provided to the LCD panel for each frame period. Therefore, the memory means is required to have a capacity for storing the video data signal for two frames. For example, the memory means has one memory part for storing one frame and another for storing the other frame. This allows a double-buffer operation for the memory means, in which a write (store) operation and a read operation are performed alternately for the two memory parts.

In the non-dispersion MLS method, as understood from the orthogonal function matrix shown in FIG. 2C, the orthogonal transform operation is sequentially performed block by block. The number of blocks is given by dividing the total number of scanning electrodes by the selection number n. Thus, a memory of the LCD utilizing the non-dispersion MLS method is required to store the input video data signal for one block instead of one frame. This makes it possible to reduce a size of the memory. Of course, in order to perform the double-buffer operation for the block data signal, the memory must be capable of storing the input video data signal for two blocks.

The selection ratio of the LC material expressed in Eq. (1) decreases sharply as the number N of the scanning electrodes (scanning lines) increases. For example, in the case where N=240, the selection ratio is about 7%; in the case where N=480, the selection ratio is about 5%. The decrease in the selection ratio causes crosstalk between the scanning signals and the data signals, resulting in degradation of the display quality.

In order to avoid such a decrease of the selection ratio, especially in LCDs having on the order of hundreds of scanning electrodes or more, a LCD panel is divided into two parts each having a half of the scanning electrodes. Each part of the LCD panel is driven independently, so as to gain a higher selection ratio and maintain a large display size and appearance. This kind of driving method in which a display panel is divided into two parts (upper and lower) and each part is scanned independently in one frame period is referred to as "dual-scan driving". A conventional driving method in which one display panel is sequentially scanned from the top to the bottom in one frame period, such as that used for CRTs, is referred to as "single-scan driving".

The selection ratio of fast-responding STN-LCDs which utilize active driving such as the MLS method is the same as that of LCDs which utilize sequential row-by-row driving, so that the selection ratio also depends on the total number N of the scanning lines. Thus, most fast-responding STN-LCDs are driven using the dual-scan driving method. In order to display conventional video data signals for single-scan display systems such as CRTs using dual-scan display systems such as LCDs, the single-scan data signal is required to be converted into a dual-scan data signal which is suitable for display in the dual-scan display system.

This single-scan/dual-scan conversion can be performed, for example, using a memory buffer having two memory regions so as to store the input video data signal for two frames. Each memory region has portions corresponding to the upper and lower halves of the LCD screen. By alternately writing and reading the input video data in/from the two memory regions, the input video data which is written to the memory buffer in a single-scan manner can be read out and displayed in a dual-scan manner (double-buffer operation for single-scan/dual-scan conversion).

A dual-port memory which can perform random write operation and serial read operation simultaneously may be used as a memory buffer. In the dual-port memory, the input video data can be written to addresses from which the stored video data of the previous frame has been read out. This makes it possible to realize the double-buffer operation using a smaller memory capacity for one frame instead of two frames, though dual-port memories are relatively expensive.

In the active driving method, the input video data is written in a memory buffer in a serial manner in the row direction, as in the case of a conventional driving method. However, in order to perform the orthogonal transform, as discussed above, the input video data stored in the memory buffer has to be read out for the selected scanning electrodes column-by-column by the time unit which is obtained by dividing one frame period by the number of pixels. A timing using such a time unit is referred to as a dot clock.

Therefore, the dual-port memory used for the single-scan/dual-scan conversion, from which the stored data is read out in a serial manner only, cannot be used as a memory buffer for the orthogonal transform operation for active driving.

A general-purpose memory can be commonly used for the single-scan/dual-scan conversion and the orthogonal transform operation. However, in the dispersion type MLS method, the memory capacity is required to store amounts of data twice as large as the video data for a whole display screen. Thus, in the non-dispersion type MLS method, which was advantageous initially for reducing the required memory capacity, the memory buffer is also required to store amounts of data twice as large as the video data for a whole display screen in order to perform the single-scan/dual-scan conversion.

FIG. 3 shows read and write operations of a memory buffer 130 which is implemented by using a general purpose memory and commonly used for the single-scan/dual-scan conversion and the orthogonal transform operation of active driving. As shown in FIG. 3, the memory buffer 130 includes two memory regions 110 and 120, each for storing the video data for one frame. The first memory region 110 is divided into two memory portions 111 and 112 corresponding to the upper and lower halves of the LCD screen, respectively. Similarly, the second memory region 120 is divided into two memory portions 121 and 122 corresponding to the upper and lower halves of the LCD screen, respectively.

The data signal of the input video data for frames A, B, C, D, . . . is supplied to the memory buffer 130 in a serial manner. As shown in FIG. 3, the video data of frame A is written in the first memory region 110 by scanning in the row direction. The data for the upper half and the lower half of the display screen are stored in the respective portions 111 and 112 in a time sequential manner. During the time period when the next video data of frame B is written in the second memory region 120, the stored video data of frame A is read out from the first memory region 110 by scanning in the column direction. That is, the video data for the upper half stored in the portion 111 and that for the lower half stored in the portion 112 are read out simultaneously.

Similarly, the next video data of frame C is written in the first memory region 110 by scanning in the row direction, while the stored video data of frame B is read out from the portions 121 and 122 of the second memory region 120 by scanning in the column direction. Then, the next video data of frame D is written in the second memory region 120 by scanning in the row direction, while the stored video data of frame C is read out from the portions 111 and 112 of the first memory region 110 by scanning in the column direction. Thus, by alternately performing write and read operations for the first and second memory regions 110 and 120, the single-scan input video data signal is converted in a dual-scan video data signal, and is displayed on the LCD panel after being subjected to the orthogonal transform.

As described above, in the conventional method, a memory buffer of a fast-responding STN-LCD is required to have a memory capacity for storing the input video data for two frames, in order to perform the single-scan/dual-scan conversion for displaying the video data carried by a single-scan video signal on a dual-scan type display, and to perform the orthogonal transform for active driving. This requirement is independent of the particular accessing methods: the AA method, the dispersion type MLS method, and the non-dispersion type MLS method.

SUMMARY OF THE INVENTION

The memory interface circuit of this invention converts an input data signal into dual-scan data signals used for a dual-scan type liquid crystal display including a display panel comprising a first portion and a second portion. The memory interface circuit includes: a memory for storing one frame of the input data signal corresponding to the display panel, and a control circuit for controlling write/read operations for the memory so that the input data signal is sequentially written in the memory in a single-scan manner, and that data stored in the memory is read out as first and second dual-scan signals in a dual-scan manner. The first dual-scan signal corresponds to the first portion of the display panel and the second dual-scan signal corresponds to the second portion of the display panel. The control circuit controls timing of read operations so that a read operation for the second dual-scan signal is started a predetermined time after that for the first dual-scan signal is started, the predetermined time being equal to a delay time of a write operation of the input data corresponding to the second portion with respect to that corresponding to the first portion.

In one embodiment of this invention, the display panel includes a plurality of display blocks each having a plurality of scanning lines, and the liquid crystal display performs an orthogonal transform on the input video signal by the display block and simultaneously selects the plurality of scanning lines by the display block. The memory includes a plurality of memory blocks each corresponding to respective one of the display blocks, and the memory has a memory capacity for storing one frame of the input data signal.

In another embodiment of this invention, the control circuit includes: a write/read decision section for deciding for which memory block a write operation should be performed, and for outputting a decision signal for directing read/write operations for the memory blocks; and an address generating section for generating a first address signal for write operations and a second address signal for read operations, whereby the input data signal is sequentially written in the plurality of the memory blocks according to the decision signal and the first address signal, and the data stored in one memory block is simultaneously read out for the corresponding display block according to the decision signal and the second address signal.

Preferably, the data stored in the plurality of memory blocks is sequentially read out by the memory block for each of the first and second portions.

In still another embodiment of this invention, the write/read decision section makes a decision according to a first horizontal synchronizing signal which is included in the input data signal, and the address generating section generates the first address signal based on the first horizontal synchronizing signal, and generates the second address signal based on a given second horizontal synchronizing signal.

In one example of the present invention, the control circuit controls timing of read and write operations so that the input data signal is written in and read out from each memory block respectively once a frame period, the frame period corresponding to one frame of the input data signal.

In another example of the present invention, the control circuit controls timing of read and write operations so that the input data is written in each memory block once a frame period, and that the data stored in each memory block is read out twice a frame period, the frame period corresponding to one frame of the input data signal.

The method of this invention is the method for controlling access operations of a memory used for converting an input data signal into dual-scan data signals used for a dual-scan type liquid crystal display including a display panel consisting of a first portion and a second portion. The memory stores one frame of the input data signal corresponding to the display panel. The method includes the steps of: (a) sequentially performing write operations of the input data signal for the memory in a single-scan manner; and (b) performing read operations for the memory whereby first and second dual-scan signals are read out in a dual-scan manner, the first dual-scan signal corresponding to the first portion of the display panel and the second dual-scan signal corresponding to the second portion of the display panel. Step (b) includes the steps of: (b1) reading the data for the first dual-scan signal from the memory; and (b2) reading the data for the second dual-scan signal from the memory a predetermined time after a start of step (b1), the predetermined time being equal to a delay time of a write operation of the input data corresponding to the second portion with respect to a write operation corresponding to the first portion, the write operations being performed in step (a).

In one embodiment of this invention, the display panel includes a plurality of display blocks each having a plurality of scanning lines, and the liquid crystal display performs an orthogonal transform on the input video signal by the display block and simultaneously selects the plurality of scanning lines by the display block, and the memory includes a plurality of memory blocks each corresponding to respective one of the display blocks, a memory capacity of the memory being a right amount for storing one frame of the input data. The method includes the steps of: (c) deciding for which memory block a write operation should be performed; (d) generating a decision signal indicating the result of step (c); (e) generating a first address signal for write operations and a second address signal for read operations; (f) performing write operations according to the decision signal and the first address signal so that the input data signal is sequentially written in the plurality of the memory blocks; and (g) performing read operations according to the decision signal and the second address signal so that the data stored in one memory block is simultaneously read out for the corresponding display block, and that the data stored in the memory blocks is sequentially read out by the memory block for each of the first and second portions.

In step (c), a decision may be made according to a first horizontal synchronizing signal included in the input data signal, and in step (e), the first address signal may be generated based on the first horizontal synchronizing signal and the second address signal may be generated based on a given second horizontal synchronizing signal.

In another embodiment of this invention, step (f) includes the steps of: (f1) setting one memory block of the memory in a write mode so as to write the input data therein based on the decision signal; and (f2) setting the other memory blocks in a read mode based on the decision signal, and step (g) includes the steps of: (g1) selecting a memory block corresponding to the first portion and another memory block corresponding to the second portion from the other memory blocks in the read mode based on the first horizontal synchronizing signal; (g2) setting the selected memory blocks in a read enable state so as to read the data therefrom; and (g3) setting non-selected memory blocks in a read-prohibit state to prevent read operation therefor.

In one example of this invention, the input data signal is written in and read out from each memory block respectively once a frame period, the frame period corresponding to one frame of the input data signal.

In another example of this invention, the input data signal is written in each memory block once a frame period, and the data stored in each memory block is read out twice a frame period, the frame period corresponding to one frame of the input data signal.

Thus, the invention described herein makes possible the advantages of (1) providing a memory interface circuit for reducing a required memory capacity of a memory buffer thereof used for fast-responding dual-scan type LCDs which utilize active driving, to a half of the conventionally required memory capacity, and (2) providing an accessing method for the memory buffer of the memory interface circuit.

These and other advantages of the present invention will become apparent to those skilled in the art upon reading and understanding the following detailed description with reference to the accompanying figures.

BRIEF DESCRIPTION OF THE DRAWINGS

FIGS. 2A to 2C are diagrams of respective examples of orthogonal functions used for the active driving method.

DESCRIPTION OF THE PREFERRED EMBODIMENTS

Hereinafter, the present invention will be described by way of illustrative examples with reference to the accompanying drawings.

EXAMPLE 1

Figure 1:
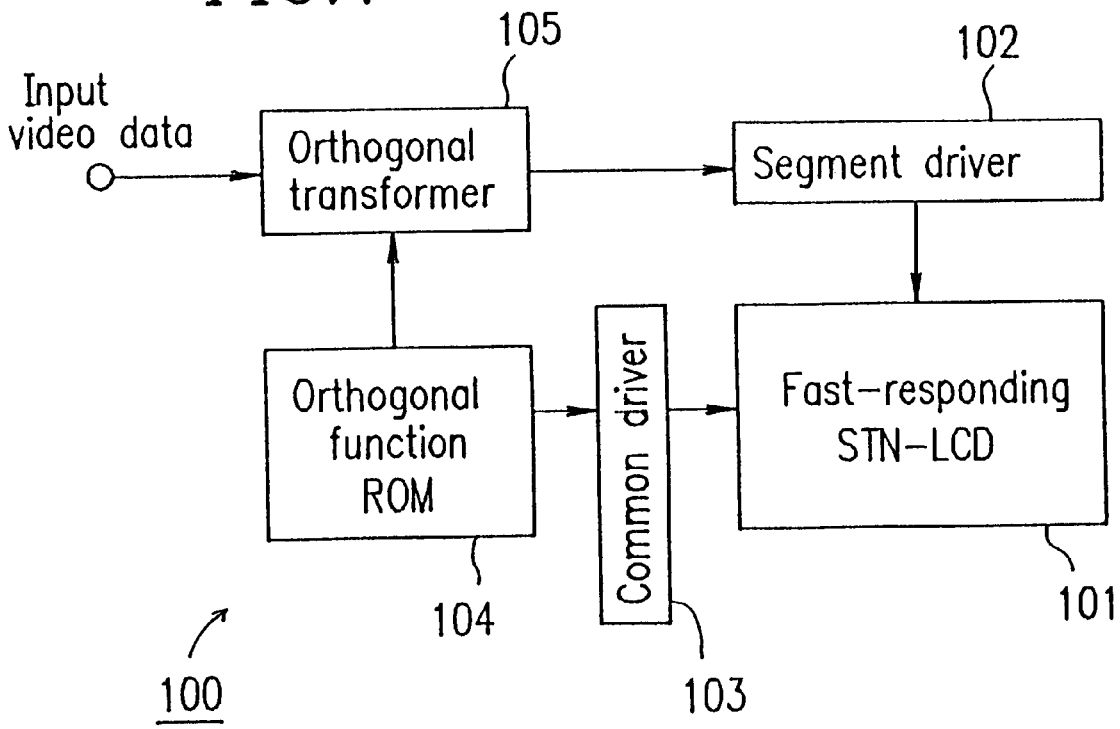
FIG. 1 is a schematic diagram illustrating a conventional LCD system utilizing an active driving method.
Figure 3:
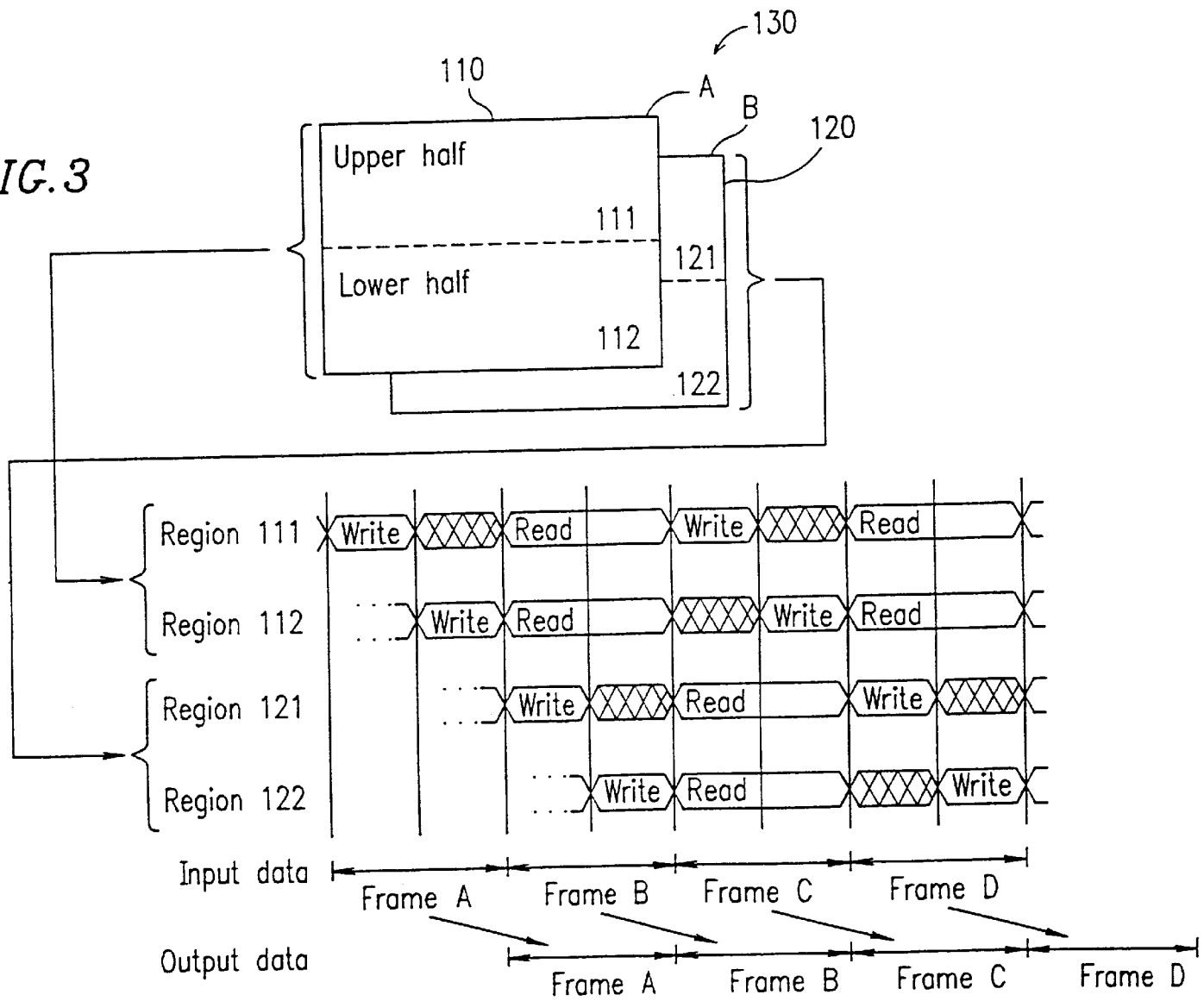
FIG. 3 is a schematic diagram illustrating conventional access operations to a general purpose memory which is used for a single-scan/dual-scan conversion and an orthogonal transform in the active driving method.
Figure 4:
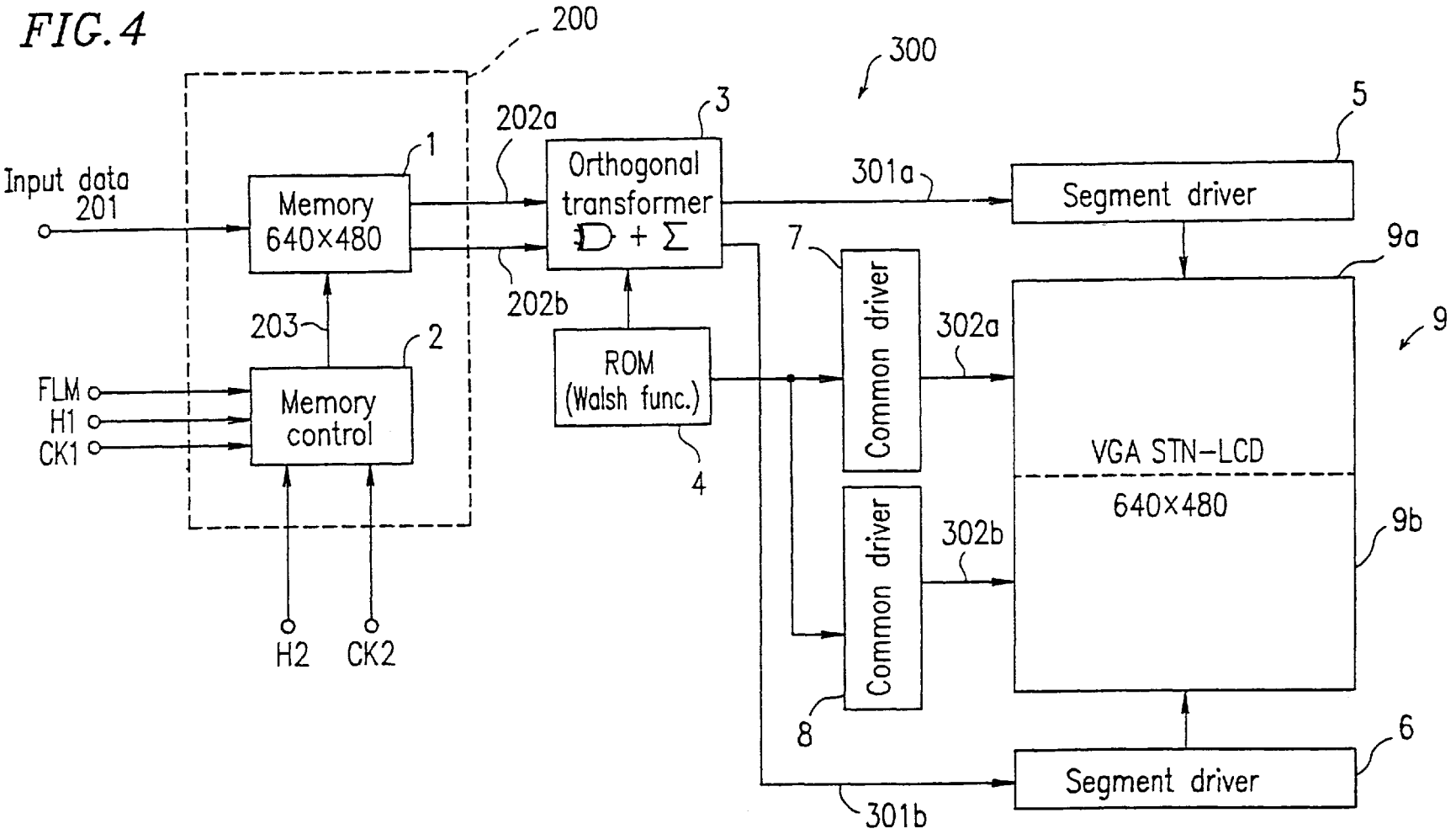
FIG. 4 is a schematic diagram illustrating a structure of a LCD provided with a memory interface circuit of the present invention.

FIG. 4 shows a memory interface circuit 200 of the present invention which is provided at an input section of a dual-scan type LCD 300. The memory interface circuit 200 receives an input single-scan video data signal 201 (also referred to herein as the input single-scan data signal and input data signal) and converts the input single-scan video data signal 201 into dual-scan video data signals 202*a* and 202*b*.

As shown in FIG. 4, the memory interface circuit 200 includes a memory 1 and a memory control circuit 2. The memory 1 has a necessary and sufficient amount of memory capacity for storing the input video data of one frame period which corresponds to a whole display screen of the LCD 300. The memory control circuit 2 controls write operations for writing the input single-scan data signal 201 in the memory 1 and access operations to read out the data stored in the memory 1 as the dual-scan data signals 202*a* and 202*b* (denoted collectively as 202). The write/read access operations of the memory 1 are controlled by a control signal 203 provided from the memory control circuit 2.

The LCD 300 includes a LCD panel 9 which is divided into an upper half 9*a* and a lower half 9*b*. The LCD panel 9 has a total number N of scanning lines (scanning electrodes), a total number M of data signal lines (data signal electrodes), and N×M pixels arranged in a matrix (not shown). In this example, the LCD panel 9 is driven by the non-dispersion type MLS method, and a number n of the scanning lines are selected at a time. That is, the N scanning lines are divided into N/n subgroups.

As shown in FIG. 4, the LCD 300 also includes an orthogonal transformer 3 for performing an orthogonal transform on the data signals 202, a ROM 4 for storing orthogonal functions such as Walsh functions used for the orthogonal transform, a first segment driver (data driver) 5 for driving the data signal lines in the upper half 9*a*, a second segment driver (data driver) 6 for driving the data signal lines in the lower half 9*b*, a first common driver (scanning driver) 7 for driving the scanning lines in the upper half 9*a*, and a second common driver (scanning driver) 8 for driving the scanning lines in the lower half 9*b*.

Initially, a basic operation principle of the memory interface circuit 200 will be described. The memory 1 is divided into a number N/n of memory blocks corresponding to orthogonal transform operation blocks in the non-dispersion type MLS method. One memory block corresponds to n scanning lines.

The input single-scan data signal 201 is written in the memory blocks of the memory 1 controlled by the memory control circuit 2 as follows:

A write operation is initiated by a frame signal FLM input to the memory control circuit 2. At first, a first memory block is supplied with the input data signal 201 during n/N of the frame period, i.e., n horizontal synchronizing periods. After the write operation of the first memory block is completed, a second memory block is supplied with the input data signal 201 during the next n/N of the frame period (next n horizontal synchronizing periods). Similarly, the input data signal 201 is sequentially supplied to the memory blocks by the n horizontal synchronizing periods, so that the input data signal 201 of one frame is written in the N/n memory blocks in a frame period. In the memory 1, N/2*n* memory blocks are assigned to the upper half 9*a* of the display panel 9, and the other N/2*n* memory blocks are assigned to the lower half 9*b*.

When the write operation of the input data signal 201 of one frame is completed, a next write operation for the input data signal 201 of the next frame is started by the frame signal FLM from the first memory block.

The video data which is carried by and written as the input single-scan data signal 201 is read out from the memory blocks of the memory 1 as the dual-scan data signals 202, controlled by the memory control circuit 2 as follows:

For the upper half 9*a* of the display panel 9, a read operation for the first memory block starts after the write operation of the first memory block is completed. A read operation for the second memory block starts immediately after the read operation of the first memory block is completed. Similarly, read operations for other succeeding memory blocks are continued until that for the N/2n-th memory block is completed. Then, the read operation returns to the first memory block. The timing for starting each read operation of the first memory block is controlled by the memory control circuit 2 so that a read operation does not conflict with a write operation in the same memory block.

In the case where a clock (frequency) for the read operation is set at ½ of that for the write operation, a frame frequency for the dual-scan data signal 202*a* for the upper half 9*a* is the same as that of the input single-scan data signal 201. In the case where the clock of the read operation is set the same as the write operation, the frame frequency of the dual-scan data signal 202*a* for the upper half 9*a* is double that of the input single-scan data signal 201. The frame frequency of the dual-scan data signals 202 is referred to as a driving frame frequency. The orthogonal transform required in the non-dispersion type MLS method can be performed by using the dual-scan data signal 202*a* for the selected scanning lines, which is read out from the corresponding memory blocks of the memory 1 by performing the read operation in the column direction.

The same read operations are performed for the lower half 9*b* of the display panel 9. By performing the read operations parallel for the upper and lower halves 9*a* and 9*b,* the single-scan data signal 201 is converted into the dual-scan data signals 202*a* and 202*b.*

Because the single-scan data signal 201 is received serially with the data for the first half of the frame preceding the data for the second half, with respect to time, the start of write operation for the lower half 9*b* is behind that for the upper half 9*a* by about a half of the frame period. As a result, the read operation of each memory block for the lower half 9*b* is also behind that for the upper half 9*a* by about a half of the frame period. Nevertheless, as a practical matter, this delay does not cause problems in the use of the LCD panel 9.

Next, the memory interface circuit 200 and the operations thereof will be explained using a specific example. In this example, the LCD 300 includes the LCD panel 9 which is a fast-responding monochrome STN-LCD panel having VGA resolution (640×480 pixels). The LCD panel 9 includes 480 scanning lines (i.e., N=480) and 640 data electrodes, utilizing the non-dispersion type MLS driving method with a scanning line selection number n=120. The frame frequency of the input single-scan signal 201 is 60 Hz. The frame frequency of each of the dual-scan signals 202 for the corresponding half of the LCD panel 9 is set at 60 Hz. Each of the upper and lower halves 9*a* and 9*b* includes 240 scanning lines.

Figure 5A:
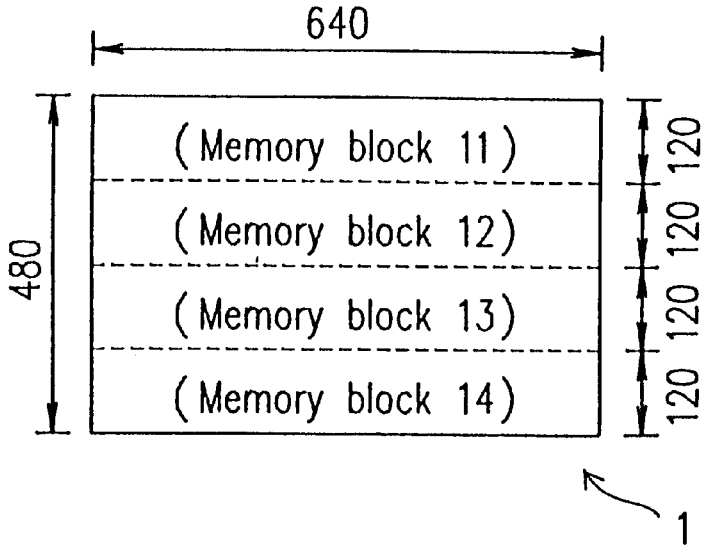
FIGS. 5A and 5B are schematic diagrams illustrating a structure of a memory of the memory interface circuit of the present invention.

As shown in FIG. 5A, the memory 1 includes four memory blocks 11 to 14, each corresponding to 120 scanning lines. The memory block 11 corresponds to a display area of the 1st to 120th scanning lines on the LCD panel 9, the memory block 12 to that of the 121st to 240th scanning lines, the memory block 13 to that of the 241st to 360th scanning lines, and the memory block 14 to that of the 361st to 480th scanning lines.

Figure 5B:
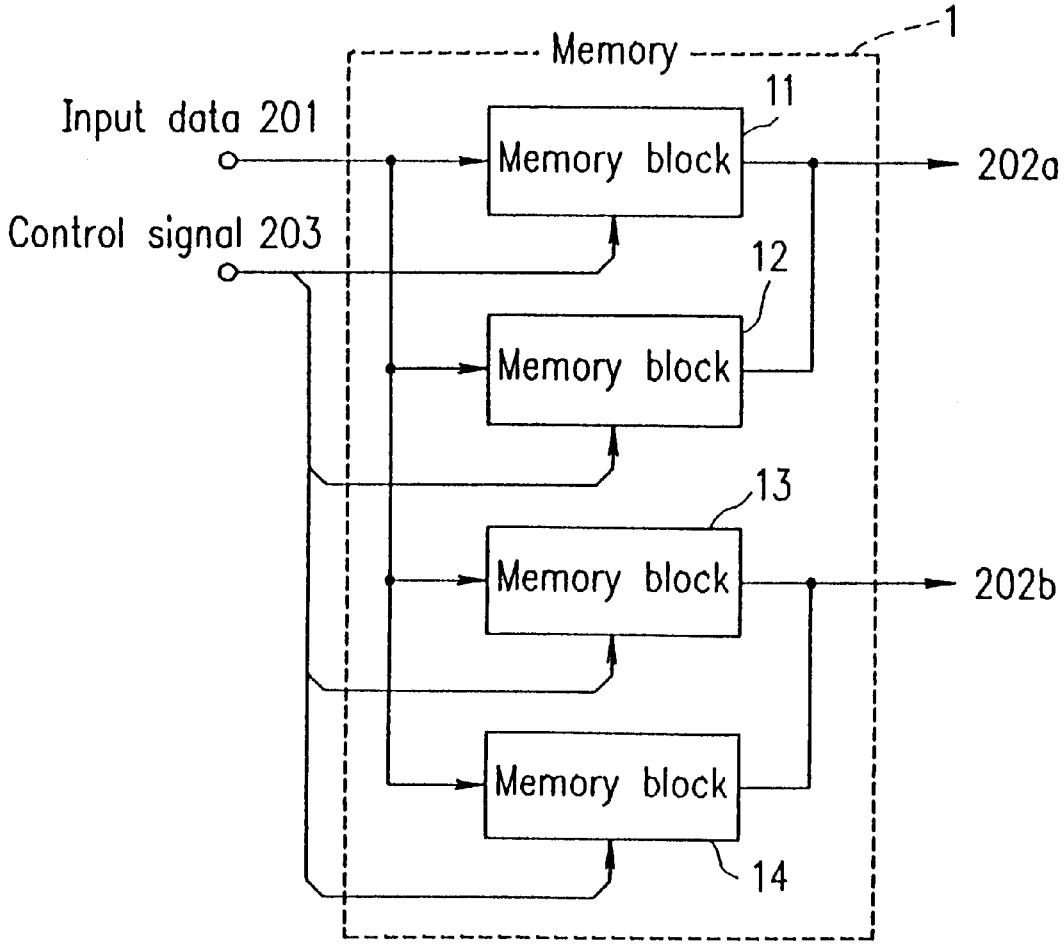

As shown in FIG. 5B, a first memory region which consists of the memory blocks 11 and 12 is assigned to the upper half 9*a,* and a second memory region which consists of the memory blocks 13 and 14 are assigned to the lower half 9*b.* Each of the memory blocks 11 to 14 receives the input single-scan data signal 201 and the control signal 203 which is supplied from the memory control circuit 2. The dual-scan data signals 202*a* and 202*b* output from the memory blocks 11 to 14 are sent to the corresponding circuits (not shown) of the orthogonal transformer 3, and are subjected to the orthogonal transform for the upper and lower halves 9*a* and 9*b,* respectively.

Figure 6:
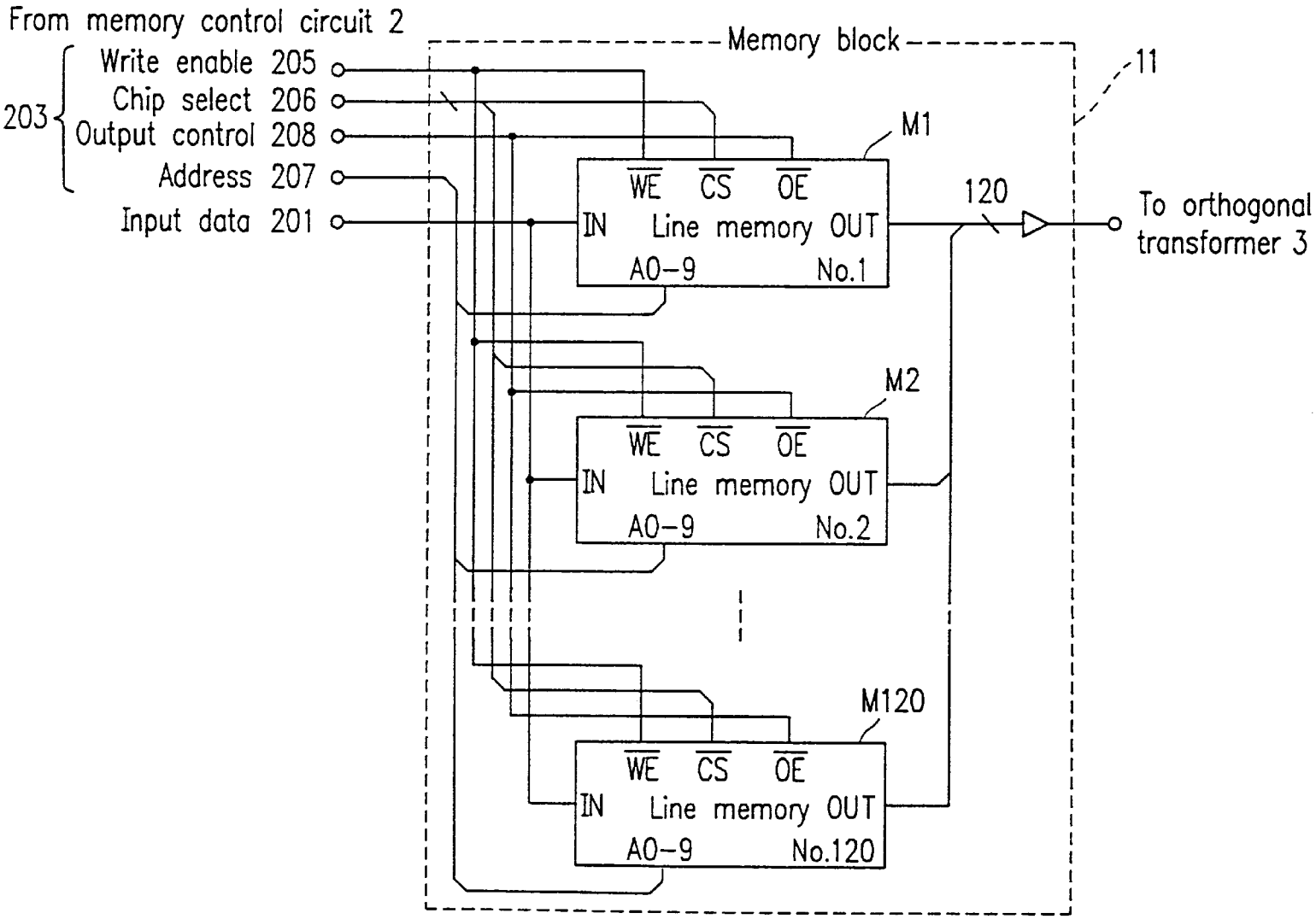
FIG. 6 is a schematic diagram illustrating a structure of each memory block of the memory.

FIG. 6 shows the detailed structure of the memory block 11. The memory blocks 12 to 14 have the same structure as that of the memory block 11. As shown in FIG. 6, the memory block 11 includes 120 line memories M1 to M120, each having a capacity of 1bit'×640. The control signal 203 from the memory control circuit 2 includes a write enable signal 205, a chip select signal 206, an address signal 207, and an output enable signal 208. The signals 205 to 208 will be explained later with reference to FIG. 8. Each line memory is provided with an one-bit data input terminal IN for receiving the input single-scan data signal 201, an one-bit data output terminal OUT, a write enable terminal WE-bar for receiving the write enable signal 205, a chip select terminal CS-bar for receiving the chip select signal 206, a ten-bit address terminal A0–9 for receiving the address signal 207, and an output enable terminal OE-bar for receiving the output enable signal 208.

Figure 7:
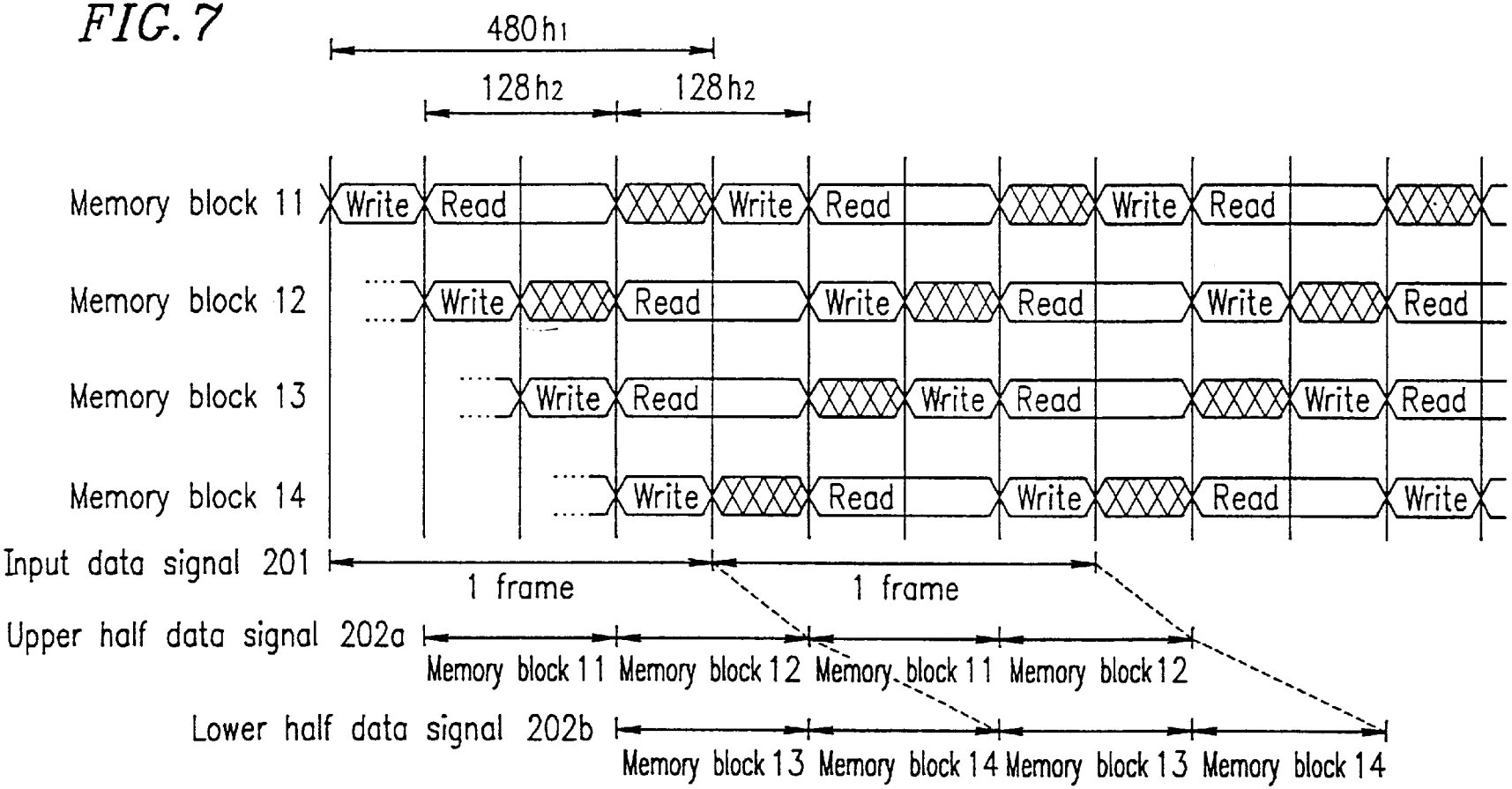
FIG. 7 is a timing chart illustrating access operations for each memory block in the memory according to one embodiment of the present invention.

FIG. 7 shows read/write operations for the memory blocks 11 to 14 in the memory interface circuit 200. As shown in FIG. 7, the input single-scan data signal 201 for one frame is written into the memory blocks 11 to 14 in a respective one-fourth of the frame period for each memory block. For the first memory region for the upper half 9*a,* a read operation is alternately performed for the memory blocks 11 and 12 every one half of the frame period. The read operation for the first memory region starts just after the write operation of the memory block 11 is completed. The data signal read out from each memory block is sent to the orthogonal transformer 3, and is applied to the upper half 9*a* of the LCD panel 9 via the first segment driver 5 (as shown in FIG. 4). The dual-scan data signal 202*a* corresponding to "upper half" of the input data signal 201 is read out and displayed in one frame period.

Similarly, for the second memory region for the lower half 9*b,* a read operation is alternately performed for the memory blocks 13 and 14 every one half of the frame period. The read operation for the second memory region starts just after the write operation of the memory block 13 is completed, i.e., a half of the frame period later than the start of the read operation for the first memory region. The data signal read out from each memory block is sent to the orthogonal transformer 3, and is applied to the lower half 9*b* of the LCD panel 9 via the second segment driver 6 (as shown in FIG. 4). The dual-scan data signal 202*b* corresponding to "lower half" of the input data signal 201 is read out and displayed in one frame period.

The input data signal 201 is serially written to the 120 line memories in each memory block in the row direction by time unit of the dot clock. That is, the write operation is performed for one line memory per horizontal synchronizing period in a row-by-row manner. On the other hand, in order to perform the orthogonal transform of the non-dispersion MLS method, the read operation for the memory block is performed in the column direction. That is, in the memory block 11, for example, the read operation is performed for the 120 line memories M1 to M120 at a time by applying a common address signal 207 to every line memory, so as to provide the video data signal for all of the 120 selected scanning lines.

Figure 8:
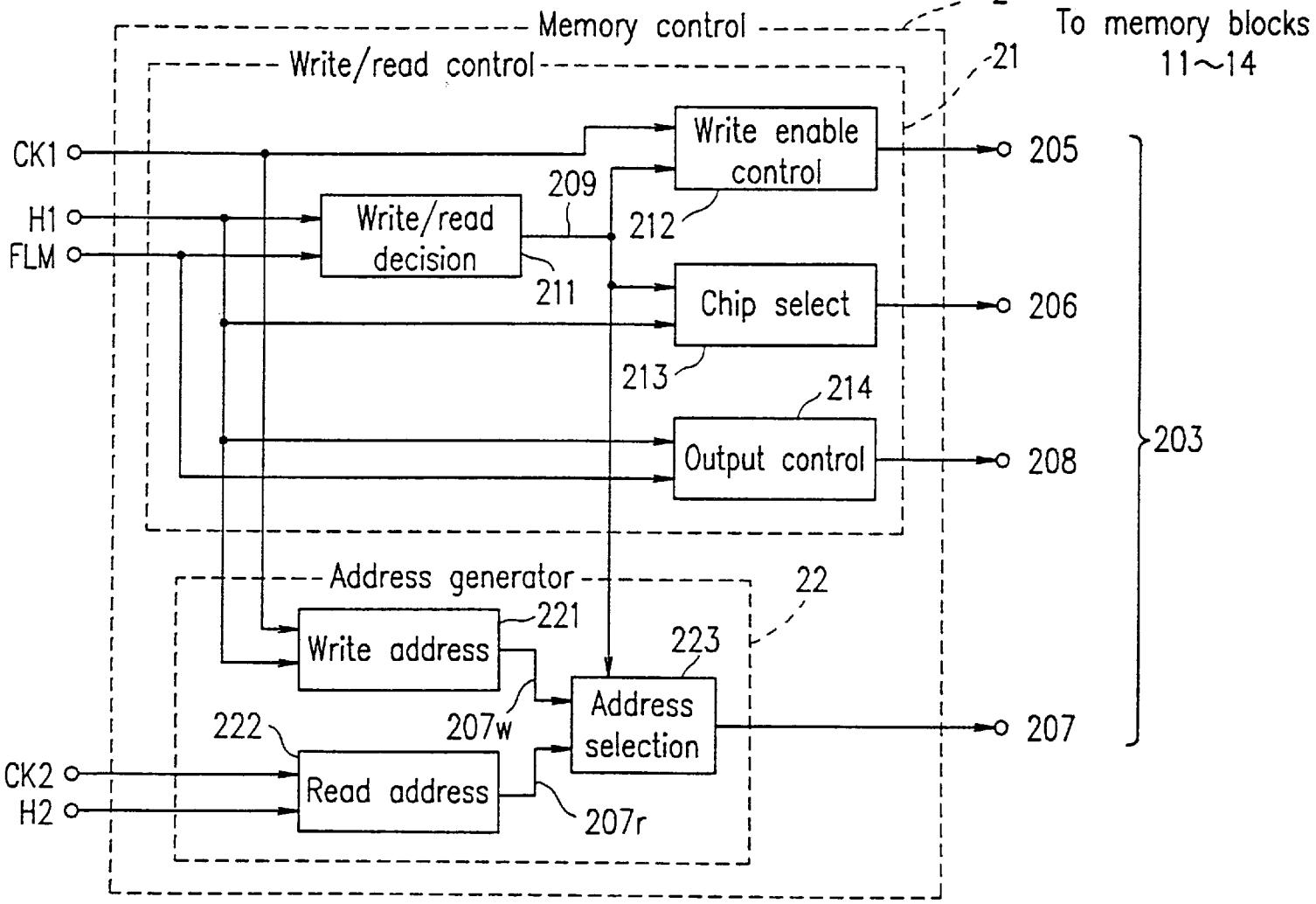
FIG. 8 is a schematic diagram illustrating a structure of a memory control circuit of the memory interface circuit.

FIG. 8 shows the structure of the memory control circuit 2 which realizes the above mentioned write/read operations. As shown in FIG. 8, the memory control circuit 2 includes a write/read controller 21 for setting an operation mode (write or read) of each memory block of the memory 1, and an address generator 22 for generating write/read addresses which are supplied to the memory blocks.

The write/read controller 21 includes a write/read decision section 211 for generating a control signal 209 for switching over the operation mode of each memory block between a write mode and a read mode, a write enable control section 212 for generating the write enable signal 205, a chip select section 213 for generating the chip select signal 206, and an output control section 214 for generating the output enable signal 208 so as to control data output operations of each memory block.

The address generator 22 includes a write address generator 221 for generating a write address signal 207*w* for the write operation of the input data signal, a read address generator 222 for generating a read address signal 207*r* for the read operation of the stored data, and an address select section 223 for selecting and outputting one of the write and read signals 207*w* and 207*r* as the address signal 207 according to the operation mode of the corresponding memory block.

The reason why the address signal 207 for controlling the memory 1 is generated by using two address signals 207*w* and 207*r* supplied from the respective address generators is as follows:

In general, the number of horizontal synchronizing pulses included in an input video signal for one frame period is different from the number of the scanning lines in the LCD panel which utilizes the active driving method. In this example, since the dual-scan method is adopted to drive the LCD panel 9 having the full panel size of 640×480, an effective driving size of the display panel is 640×240 (i.e., the size of the upper or lower half 9*a* or 9*b*).

When the half of the LCD panel 9 is driven by the non-dispersion type MLS method, the total number N of the scanning lines is 240 and the scanning line selection number n is 120. In case where the Walsh functions are used for the orthogonal transform matrix, the matrix has a size of 120 (rows)×128 (columns), where the number of the columns is given by $2^m$. Thus, the number of the horizontal synchronizing pulses (scan-selection pulses) for read operation which are generated in one frame period T of the input single-scan data signal 201 is 128×2=256, where multiplying 2 is the number of the blocks (subgroups) given by N/n=240/120.

The input single-scan data signal 201 corresponds to a display panel having a size of 640×480, so that the number of horizontal synchronizing pulses of the input single-scan signal in one frame period T is about 525 which includes 480 pulses for scanning and those for horizontal blanking. Nevertheless, in order to simplify the explanation, let the number of horizontal synchronizing pulses be 480 in one frame period, omitting the horizontal blanking. Thus, the number of horizontal synchronizing pulses for the half panel is 240 in one frame period, simply utilizing the dual-scan driving.

A horizontal synchronizing period h1 used for writing the input video data to the memory 1 is given by dividing the frame period T by 480. On the other hand, a horizontal synchronizing period h2 used for reading out the stored video data from the memory 1 is given by dividing the frame period T by 256, not by 240 which is half of 480.

Accordingly, the number of the horizontal synchronizing pulses in one frame is different between the write operation (T/h1) and read operation (T/h2), so that two different address signals (i.e., clock signals) are required.

Next, the specific operations of the memory control circuit 2 will be described with reference to FIGS. 7 and 8. When the frame signal FLM of the input data signal 201 is input, the memory control circuit 2 sets the memory block 11 in the write operation mode so as to write the input data signal 201 into the memory block 11 as follows:

The write/read decision section 211 receives the frame signal FLM and a horizontal synchronizing signal H1 of the input data signal 201, and decides a respective current operation mode for each of the memory blocks 11 to 14 based on the frame signal FLM and pulses of the horizontal synchronizing signal H1. The write/read decision section 211 may be implemented, for example, by a counter circuit using the frame signal FLM as a load signal and the horizontal synchronizing signal H1 as a clock signal.

A time period, during which the first 120 pulses (120h1) of the horizontal synchronizing signal H1 are input after the frame signal FLM, is determined as a write mode period for the memory block 11 and a read mode period for other memory blocks 12 to 14. Similarly, a time period, during which the 121st to 240th pulses of the horizontal synchronizing signal H1 are input, is determined as the write mode period for the memory block 12 and the read mode period for other memory blocks 11, 13, and 14, and so on. As shown in FIG. 8, a decision signal 209 indicating which one of the memory blocks is to be set in the write mode in the current period (for example, the memory block 11) is output from the write/read decision section 211. The decision signal 209 is sent to the write enable control section 2–12, the chip select control section 213, and the address select section 223 of the address generator 22.

The write enable control section 212, receiving the decision signal 209, selectively supplies a write enable signal 205 for each memory block. The write enable control section 212 sends a write clock signal CK1 as the write enable signal 205 to the memory block 11 for which the write operation is performed. The write enable control section 212 sends the write enable signal 205 having a high level (Hi) to the other memory blocks so as to set them in the read mode. At this time, as described below, in the memory block 11 in the write mode, the data signal is written to the line memory which has been supplied with a chip select signal 206 having a low level (Lo), i.e., in an operation enable state, when the write enable signal 205 goes low (Lo).

The chip select control section 213, receiving the decision signal 209, supplies a signal having a low level (Lo) as a chip select signal 206 to the memory blocks 12 to 14 for which the read operation is performed. For the memory block 11 in the read mode, the chip select control section 213 supplies a signal CS-bar having the low level (Lo) as the chip select signal 206 to one of the 120 line memories to which the data signal is to be written every horizontal synchronizing period h1, according to the frame signal FLM and the horizontal synchronizing signal H1. To the other 119 line memories, the chip select control section 213 supplies the signal CS-bar having a high level (Hi) so as to prevent unnecessary write operations.

The output control section 214 sets two of the three memory blocks which are in the read mode to an output enable state for outputting the data signal. From each of the two memory blocks in the output enable state, the stored video data is output from the 120 line memories at the same time. The output control section 214 sets the other two memory blocks (one memory block being in the write mode and the last one in the read mode) in an output prohibit state. In the output prohibit state, the output impedance of the memory block is set high so as not to effect the output of the memory blocks in the output enable state. As shown in FIG. 7, for example, when the memory block 11 is in the write mode, the memory blocks 12 and 13 are at the output enable state in the read mode, and the memory block 14 is at the output prohibit state in the read mode.

At this time, each of the memory blocks is provided with the corresponding address signal 207 from the address generator 22. As shown in FIG. 8, the write address generator 221 generates a write address signal 207*w* based on the write clock signal CK1 and the horizontal synchronizing signal H1 for write operation. The read address generator 222 generates a read address signal 207*r* based on the read clock signal CK2 and the horizontal synchronizing signal H2 for read operation. The address select section 223 receives the write and read address signals 207*w* and 207*r* and selectively outputs one of them as the address signal 207 according to the decision signal 209. As shown in FIG. 7, the address select section 223 supplies, for example, the write address signal to the memory block 11 and the read address signal to the memory blocks 12 to 14, as the respective address signal 207.

As described above, during a time period from the time when the frame signal FLM is input, the input data signal is sequentially written in the 120 line memories of the memory block 11 one by one according to every pulse of the horizontal synchronizing signal H1 until 120 pulses are input. During this time period, the previously stored video data is read out from the 120 line memories of each of the memory blocks 12 and 13 at the same time in the column direction. The frame period T of the input data signal 201 corresponds to 480 pulses of the write horizontal synchronizing signal H1, and to 256 pulses of the read horizontal synchronizing signal H2.

Similarly, the memory block 12 is set in the write mode in a time period during which the 121st to 240th pulses of the write horizontal synchronizing signal H1 are input, while the stored data is read out from the memory blocks 11 and 14, as shown in FIG. 7. The memory block 13 is set in the write mode in the next time period during which the 241st to 360th pulses of the write horizontal synchronizing signal H1 are input, while the stored data is read out from the memory blocks 11 and 14, And then the memory block 14 is set in the write mode in the next time period during which the 361st to 480th pulses of the write horizontal synchronizing signal H1 are input, while the stored data is read out from the memory blocks 12 and 13.

The thus read out data is sent to the orthogonal transformer 3 as the dual-scan data signals 202*a* and 202*b*, as shown in FIG. 4. The orthogonal transformer 3 transforms each of the dual-scan data signals 202*a* and 202*b* using the respective orthogonal matrices given from Walsh function ROM 4. The transformed video data signals 301*a* and 301*b* are applied to the data electrodes of the upper and lower halves 9*a* and 9*b* of the LCD panel 9, respectively, via the first and second segment drivers 5 and 6.

Column vector elements of the orthogonal matrices are applied as pulse scanning signals 302*a* and 302*b* to the scanning lines of the upper and lower halves 9*a* and 9*a* of the LCD panel 9, respectively, via the first and second common drivers 7 and 8. Thus, the inverse orthogonal transformation is performed for the transformed video data on the upper and lower halves 9*a* and 9*b* of the LCD panel 9, so that the input video data is reproduced on the LCD panel 9.

As described above, according to the memory interface circuit 200 of the present invention, the input single-scan data signal 201 is converted into the dual-scan data signals 202 using the memory 1 having a necessary and sufficient amount of memory capacity for storing one frame of the input data signal. This amount of the memory capacity is a half that required for conventional buffer memories. Furthermore, the data signal required for the orthogonal transform of the non-dispersion type MLS method can be effectively supplied from the memory 1 without an increase of the required memory capacity.

Accordingly, the fast-responding dual-scan type VGA STN-LCD panel 9 is effectively driven by the non-dispersion MLS method so as to realize a high contrast display using a small size memory for storing one frame of the input video data.

In this example, the memory interface circuit 200 is explained for the monochrome input video signal 201 for monochrome LCD panels. For color LCD panels, by providing a memory for each color (or a memory having a capacity for storing three-color video signals), the interface memory circuit of the present invention can realize the single-scan/dual-scan conversion and the effective provision of the video data for the orthogonal transform using a one-frame capacity for each color.

In this example, the LCD panel 9 is driven by using the non-dispersion type MLS method with the scanning line selection number n of 120. The present invention is also applicable for LCD panels utilizing such a method as an intra-block-dispersion type MLS method which is based on the non-dispersion type MLS method and in which a plurality n' of scanning lines are simultaneously selected from n scanning lines included in one block. In this case, the number of the line-memories from which the video data is read out simultaneously is set as the number n'.

EXAMPLE 2

Next, the memory interface circuit 200 and the operations thereof will be explained using another specific example. In this example, as in the first example, the LCD 300 includes the LCD panel 9 which is a fast-responding monochrome STN-LCD panel having VGA resolution (640×480 pixels). The LCD panel 9 includes 480 scanning lines (i.e., N=480) and 640 data electrodes, utilizing the non-dispersion type MLS driving method with the scanning line selection number n=120. The frame frequency of the input single-scan signal 201 is 60 Hz. The frame frequency of each dual-scan signal 202 for the corresponding half of the LCD panel 9 is set at 120 Hz. The frame frequency of each dual-scan signal 202 is referred to as a driving frame frequency. Each of the upper and lower halves 9*a* and 9*a* includes 240 scanning lines.

The structure of the memory interface circuit 200 is the same as that of the first example, so that the detailed explanation is omitted for sake of brevity.

Figure 9:
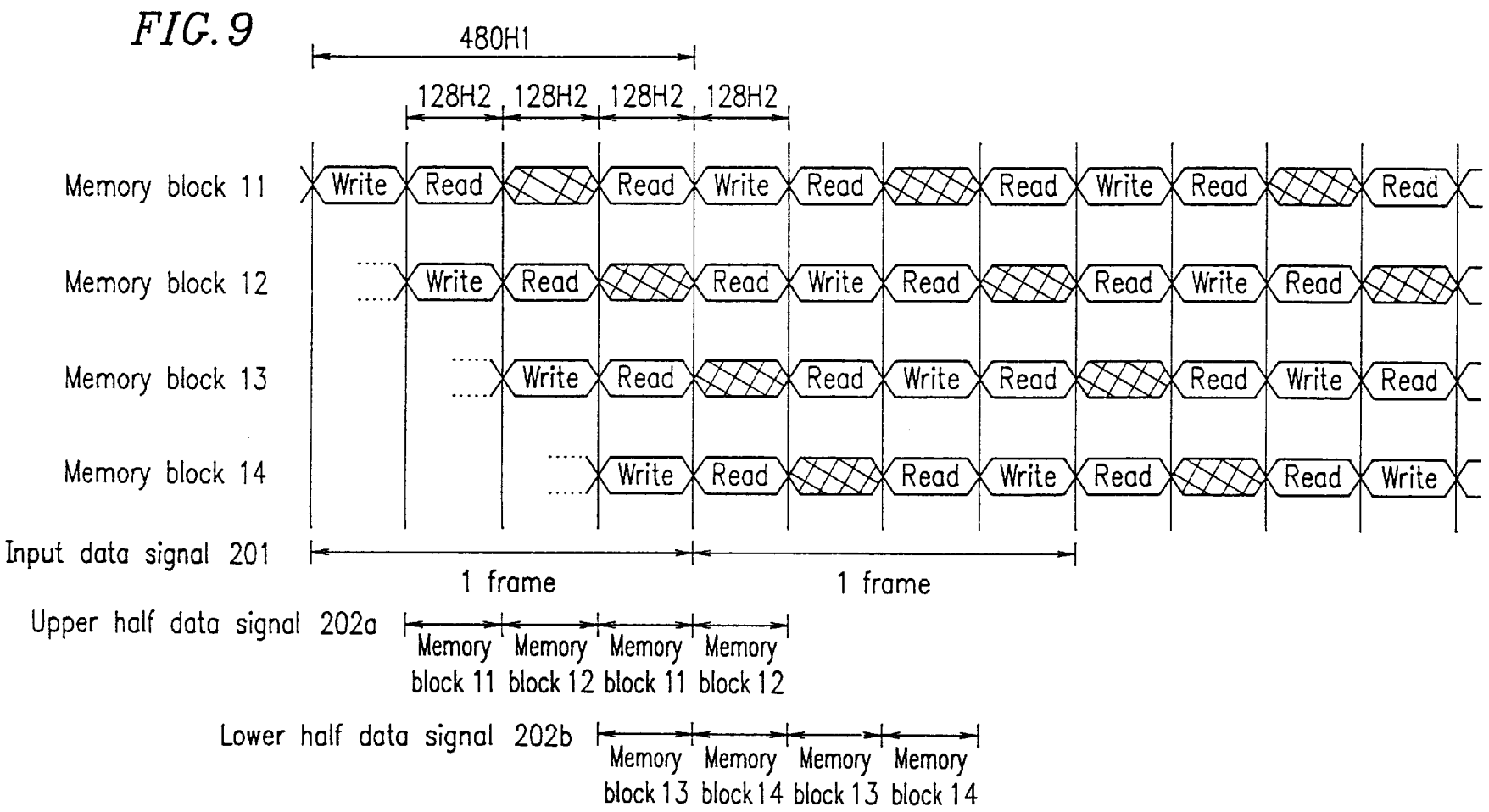
FIG. 9 is a timing chart illustrating access operations for each memory block in the memory according to another embodiment of the present invention.

FIG. 9 shows read/write operations for the memory blocks 11 to 14 in the memory interface circuit 200 of this example. As shown in FIG. 9, the input single-scan data signal 201 for one frame is written into the memory blocks 11 to 14 in a respective one-fourth of the frame period for each memory block. In this example, one frame period T of the input single-scan data signal 201, i.e., one frame period (480 pulses) of the horizontal synchronizing signal H1 (480h1) for a write operation corresponds to two frame periods (512 pulses) of the horizontal synchronizing signal H2 (256h2×2) for a read operation. That is, in this example, a read rate (120 Hz) for reading the data from the memory 1 is twice as fast as write rate (60 Hz) for writing the data in the memory 1. Thus, the same data stored in each memory block is read out twice with respect to a frame period of the input video signal 201.

Next, the specific operations of the memory control circuit 2 of this example will be described with reference to FIGS. 8 and 9. When the frame signal FLM of the input data signal 201 is input, the memory control circuit 2 sets the memory block 11 in the write mode so as to write the input data signal into the memory block 11 as follows:

The write/read decision section 211 receives the frame signal FLM and a horizontal synchronizing signal H1 of the input data signal 201, and decides the respective current operation modes of the memory blocks 11 to 14 based on the frame signal FLM and pulses of the horizontal synchronizing signal H1. Similar to the first example, a time period during which the first 120 pulses of the horizontal synchronizing signal H1 are input after the frame signal FLM is determined as the write mode period for the memory block 11 and the read mode period for other memory blocks 12 to 14. Similarly, a time period during which the 121st to 240th pulses of the horizontal synchronizing signal H1 are input is determined as the write mode period for the memory block 12 and the read mode period for other memory blocks 11, 13 and 14, and so on. As shown in FIG. 8, the decision signal 209 indicating the write/read mode of each memory block is sent to the write enable control section 212, the chip select control section 213, and the address select section 223 of the address generator 22.

The write enable control section 212, receiving the decision signal 209, selectively supplies a write enable signal 205 for the memory blocks. The write enable control section 212 sends a write clock signal CK1 as the write enable signal 205 to the memory block 11 in the write mode. The write enable control section 212 sends the write enable signal 205 having a high level (Hi) to the other memory blocks so as to set them in the read mode. At this time, as described below, in the memory block 11 in the write mode, the data signal is written to the line memory which has been supplied with a chip select signal 206 having a low level (Lo), i.e., in an operation enable state, when the write enable signal 205 goes low (Lo).

The chip select control section 213, receiving the decision signal 209, supplies the chip select signal 206 having the low level (Lo) to the memory blocks 12 to 14 in the read mode. For the memory block 11 in the write mode, the chip select control section 213 supplies a signal CS-bar having the low level (Lo) as the chip select signal 206 to one of the 120 line memories to which the data signal is to be written every horizontal synchronizing period h1, according to the frame signal FLM and the horizontal synchronizing signal H1. To the other 119 line memories, the chip select control section 213 supplies the signal CS-bar having the high level (Hi) so as to prevent unnecessary write operations.

The output control section 214 sets two of the three memory blocks in the read mode to an output enable state for outputting the data signal. From each memory block in the output enable state, the stored video data is output from the 120 line memories at the same time. The output control section 214 sets the other two memory blocks (one memory block being in the write mode and the last one in the read mode) in an output prohibit state. In the output prohibit state, the output impedance of the memory block is set high so as not to effect the output of the memory blocks in the output enable state. As shown in FIG. 9, for example, when the memory block 11 is in the write mode, the memory blocks 12 and 14 are at the output enable state in the read mode, and the memory block 13 is at the output prohibit state in the read mode.

At this time, the address generator 22 selectively provides the corresponding address signal 207 to the memory blocks, as described above in the first example.

As described above, from the time when the frame signal FLM is input, the input data signal is sequentially written in the 120 line memories of the memory block 11 one by one with every pulse of the horizontal synchronizing signal H1 until 120 pulses thereof are input. During this time period of 120h1, the previously stored video data is read out from the 120 line memories of each of the memory blocks 12 and 14 at the same time in the column direction. In this time period, the data for the upper half 9*a* is read out for the second time from the memory block 12, and the data for the lower half 9*b* is read out for the first time immediately after the previous write operation for the memory block 14, as shown in FIG. 9. One frame period of the input signal 201 corresponds to 480 pulses of the write horizontal synchronizing signal H1, and to 512 pulses (two frames) of the read horizontal synchronizing signal H2.

Similarly, the memory block 12 is set in the write mode in a time period during which the 121st to 240th pulses of the write horizontal synchronizing signal H1 are input, while the stored data is read out from the memory blocks 11 (for the first time immediately after the write operation) and 13 (for the second time), as shown in FIG. 9. The memory block 13 is set in the write mode in the next time period during which the 241st to 360th pulses of the write horizontal synchronizing signal H1 are input, while the stored data is read out from the memory blocks 12 (for the first time immediately after the write operation) and 14 (for the second time). The memory block 14 is then set in the write mode in the next time period during which the 361st to 480th pulses of the write horizontal synchronizing signal H1 are input, while the stored data is read out from the memory blocks 11 (for the second time) and 13 (for the first time immediately after the write operation).

The thus read out data is sent to the orthogonal transformer 3 as the dual-scan data signals 202*a* and 202*b*, as shown in FIG. 4. The following operations are the same as that of the first example.

In the second example, the data stored in the memory block is read out twice, and the orthogonal transform is performed each time the data is read out. However, the orthogonal transforms which are performed on the same data are not necessarily the same, since one orthogonal transform on the data is completed each time so that different orthogonal functions can be used for the first read-out data and the second read-out data.

By increasing the driving frame frequency (clock for read operations), sufficient contrast can be achieved by a smaller scanning line selection number n, since a high driving frame frequency can suppress the frame response. Thus, the second example is advantageous with respect to the contrast.

On the other hand, a high driving frame frequency increases the power consumption of the drivers (driving circuits), loss of effective voltage value applied to a selected pixel, and crosstalk. This causes degradation of the display quality of LCDs. Thus, the first example is advantageous with respect to power consumption and display quality.

As described above, according to the memory interface circuit 200 of the present invention, the input single-scan data signal 201 is converted into the dual-scan data signals 202 using the memory 1 having a necessary and sufficient amount of memory capacity for storing one frame of the input data signal. This amount of the memory capacity is a half as small as that required for conventional buffer memories. Furthermore, the data signal required for the orthogonal transform of the non-dispersion type MLS method can be effectively supplied from the memory 1 without increase of the required memory capacity.

Accordingly, the fast-responding dual-scan type VGA STN-LCD panel 9 is effectively driven by the non-dispersion MLS method so as to realize a high contrast display using a small size memory for storing one frame of the input video data.

The present invention has been described for the examples of LCDs utilizing dual-scan driving. However, the present invention can be expanded to multi-scan driving, in which the LCD panel is divided in a plurality of portions and the plurality of multi-scan signals are used.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A memory interface circuit for converting an input data signal into multi-scan data signals used for a multi-scan type liquid crystal display including a display panel comprising a first portion and a second portion, the memory interface circuit including:

a memory for receiving and storing one frame of the input data signal corresponding to the display panel, and a control circuit for controlling write/read operations for the memory so that the input data signal is sequentially written in the memory in a single-scan manner, and that data stored in the memory is read out as first and second multi-scan signals in a multi-scan manner, the first multi-scan signal corresponding to the first portion of the display panel and the second multi-scan signal corresponding to the second portion of the display panel, wherein the control circuit controls the timing of read operations so that a read operation for the second multi-scan signal is started a predetermined time after a read operation for the first multi-scan signal is started and before the read operation of the first multi-scan signal is completed, the predetermined time being equal to a delay time of a start of a write operation of the input data signal corresponding to the second portion with respect to a start of a write operation of the input data signal corresponding to the first portion.

2. A memory interface circuit according to claim 1, wherein the display panel includes a plurality of display blocks each having a plurality of scanning lines, and the liquid crystal display performs an orthogonal transform on the input video signal by the display block and simultaneously selects the plurality of scanning lines by the display block, and wherein the memory means includes a plurality of memory blocks each corresponding to respective one of the display blocks, and the memory means has a memory capacity for storing one frame of the input data signal.

3. A memory interface circuit according to claim 2, wherein the control circuit includes:

a write/read decision circuit for deciding for which memory block a write operation should be performed, and for outputting a decision signal for directing read/write operations for the memory blocks; and an address generator for generating a first address signal for write operations and a second address signal for read operations, whereby the input data signal is sequentially written in the plurality of the memory blocks according to the decision signal and the first address signal, and the data stored in one memory block is simultaneously read out for the corresponding display block according to the decision signal and the second address signal.

4. A memory interface circuit according to claim 3, wherein the data stored in the plurality of memory blocks is sequentially read out by the memory block for each of the first and second portions.

5. A memory interface circuit according to claim 3, wherein the write/read decision circuit makes a decision according to a first horizontal synchronizing signal which is included in the input data signal, and wherein the address generator generates the first address signal based on the first horizontal synchronizing signal, and generates the second address signal based on a given second horizontal synchronizing signal.

6. A memory interface circuit according to claim 2, wherein the control circuit controls timing of read and write operations so that the input data signal is written in and read out from each memory block respectively once a frame period, the frame period corresponding to one frame of the input data signal.

7. A memory interface circuit according to claim 2, wherein the control circuit controls timing of read and write operations so that the input data is written in each memory block once a frame period, and that the data stored in each memory block is read out twice a frame period, the frame period corresponding to one frame of the input data signal.

8. A memory interface circuit according to claim 1, wherein the control circuit further controls the timing of write operations so that a write operation of the input data corresponding to the first portion for one frame is started before a completion of the read operation for the second multi-scan signal for the second portion for the previous frame.

9. A memory interface circuit according to claim 8, wherein the memory includes a plurality of memory blocks, and wherein the write operation of the input data corresponding to the first portion for one frame is started before a completion of the read operation for the first multi-scan signal for the first portion for the previous frame, and the write operation of the input data corresponding to the second portion for said one frame is started before a completion of the read operation for the second multi-scan signal for the second portion for the previous frame.

10. A method for controlling access operations of a memory used for converting an input data signal into multi-scan data signals used for a multi-scan type liquid crystal display including a display panel comprising a first portion and a second portion, the memory storing one frame of the input data signal corresponding to the display panel, the method including the steps of:

(a) sequentially performing write operations of the input data signal for the memory in a single-scan manner; and (b) performing read operations for the memory whereby first and second multi-scan signals are read out in a multi-scan manner, the first multi-scan signal corresponding to the first portion of the display panel and the second multi-scan signal corresponding to the second portion of the display panel, wherein step (b) includes the steps of:

(b1) reading the data for the first multi-scan signal from the memory; and (b2) reading the data for the second multi-scan signal from the memory a predetermined time after a beginning of step (b1) and before a completion of step (b1), the predetermined time being equal to a delay time of a beginning of the write operation of the input data signal corresponding to the second portion with respect to a beginning of the write operation of the input data signal corresponding to the first portion, the write operations being performed in step (a).

11. A method for controlling access operations of the memory according to claim 10, wherein the display panel includes a plurality of display blocks each having a plurality of scanning lines, and the liquid crystal display performs an orthogonal transform on the input video signal by the display block and simultaneously selects the plurality of scanning lines by the display block, and the memory includes a plurality of memory blocks each corresponding to respective one of the display blocks, a memory capacity of the memory being a right amount for storing one frame of the input data, the method including the steps of:

(c) deciding for which memory block a write operation should be performed;

(d) generating a decision signal indicating the result of step (c);

(e) generating a first address signal for write operations and a second address signal for read operations;

(f) performing write operations according to the decision signal and the first address signal so that the input data signal is sequentially written in the plurality of the memory blocks; and (g) performing read operations according to the decision signal and the second address signal so that the data stored in one memory block is simultaneously read out for the corresponding display block, and that the data stored in the memory blocks is sequentially read out by the memory block for each of the first and second portions.

12. A method for controlling access operations of the memory according to claim 11, wherein in step (c), a decision is made according to a first horizontal synchronizing signal included in the input data signal, and in step (e), the first address signal is generated based on the first horizontal synchronizing signal and the second address signal is generated based on a given second horizontal synchronizing signal.

13. A method for controlling access operations of the memory according to claim 11, wherein step (f) includes the steps of:

(f1) setting one memory block of the memory means in a write mode so as to write the input data therein based on the decision signal; and (f2) setting the other memory blocks in a read mode based on the decision signal, and wherein step (g) includes the steps of:

(g1) selecting a memory block corresponding to the first portion and another memory block corresponding to the second portion from the other memory blocks in the read mode based on the first horizontal synchronizing signal;

(g2) setting the selected memory blocks in a read enable state so as to read the data therefrom; and (g3) setting non-selected memory blocks in a read-prohibit state to prevent read operation therefor.

14. A method for controlling access operations of the memory according to claim 11, wherein the input data signal is written in and read out from each memory block respectively once a frame period, the frame period corresponding to one frame of the input data signal.

15. A method for controlling access operations of the memory according to claim 11, wherein the input data signal is written in each memory block once a frame period, and the data stored in each memory block is read out twice a frame period, the frame period corresponding to one frame of the input data signal.

16. A method for controlling access operations of the memory according to claim 10, wherein the step (a) is performed so that a write operation of the input data signal corresponding to the first portion for one frame is started before a completion of the read operation for the second multi-scan signal for the second portion for the previous frame.

17. A method for controlling access operations of the memory according to claim 16, wherein the memory includes a plurality of memory blocks, and wherein the write operation of the input data corresponding to the first portion for one frame is started before a completion of the read operation for the first multi-scan signal for the first portion for the previous frame, and the write operation of the input data corresponding to the second portion for said one frame is started before a completion of the read operation for the second multi-scan signal for the second portion for the previous frame.

18. A memory interface circuit for converting an input data signal into multi-scan data signals used for a multi-scan type liquid crystal display including a display panel comprising a first portion having a plurality of scanning signal lines and a second portion having a plurality of scanning signal lines, the memory interface circuit including:

a memory for receiving and storing one frame of the input data signal corresponding to the display panel, and a control circuit for controlling write/read operations for the memory so that the input data signal is sequentially written in the memory in a single-scan manner, and that data stored in the memory is read out as first and second multi-scan signals in a multi-scan manner, the first multi-scan signal corresponding to the first portion of the display panel and the second multi-scan signal corresponding to the second portion of the display panel, wherein at least two lines of the scanning signal lines of the first portion are selected simultaneously, and each of the at least two lines of the scanning signal lines of the first portion is supplied with a plurality of selection pulses per frame and at least two lines of the scanning signal lines of the second portion are selected simultaneously, and each of the at least two lines of the scanning signal lines of the second portion is supplied with a plurality of selection pulses per frame.

19. A memory interface circuit according to claim 18, wherein the at least two lines of the scanning signal lines of the first and second portions are selected simultaneously using a non-dispersion type MLS method.

* * * * *